US008939101B2

(12) United States Patent
Seigneurie

(10) Patent No.: US 8,939,101 B2
(45) Date of Patent: Jan. 27, 2015

(54) PASSENGER SHIP OF WHICH THE SUPERSTRUCTURE IS EQUIPPED WITH AT LEAST ONE ARCH

(75) Inventor: Jean-Charles Seigneurie, Nantes (FR)

(73) Assignee: STX France S.A., Saint Nazaire (FR)

( * ) Notice: Subject to any disclaimer, the term of this patent is extended or adjusted under 35 U.S.C. 154(b) by 299 days.

(21) Appl. No.: 13/451,692

(22) Filed: Apr. 20, 2012

(65) Prior Publication Data

US 2012/0266804 A1 Oct. 25, 2012

(30) Foreign Application Priority Data

Apr. 22, 2011 (FR) ..... 11 53502

(51) Int. Cl.

| | |
|---|---|
| ***B63B 3/00*** | (2006.01) |
| ***B63B 5/00*** | (2006.01) |
| ***B63B 9/06*** | (2006.01) |
| ***B63B 15/00*** | (2006.01) |
| ***B63B 35/54*** | (2006.01) |
| *B63B 3/70* | (2006.01) |

(52) U.S. Cl.

CPC ..... *B63B 15/00* (2013.01); *B63B 35/54* (2013.01); *B63B 3/70* (2013.01)

USPC ..... 114/65 R; 114/83

(58) Field of Classification Search

USPC ..... 114/343, 364, 83, 85

See application file for complete search history.

(56) References Cited

U.S. PATENT DOCUMENTS

| | | | | |
|---|---|---|---|---|
| 4,907,524 | A | 3/1990 | Hart et al. | |
| 5,359,958 | A * | 11/1994 | Guild | 114/272 |
| 7,216,604 | B2 * | 5/2007 | Finney et al. | 114/361 |
| 7,527,006 | B2 * | 5/2009 | Khachaturian | 114/50 |
| 7,798,089 | B2 * | 9/2010 | McKeand | 114/364 |
| 7,810,443 | B2 | 10/2010 | Preiss | |
| 7,845,296 | B1 * | 12/2010 | Khachaturian | 114/50 |
| 7,895,964 | B2 * | 3/2011 | Russikoff | 114/361 |
| 8,061,289 | B2 * | 11/2011 | Khachaturian | 114/51 |
| 8,359,994 | B1 * | 1/2013 | Highfield | 114/361 |
| 2010/0107951 | A1 | 5/2010 | Pelerin et al. | |

FOREIGN PATENT DOCUMENTS

| | | | |
|---|---|---|---|
| FR | 2943309 | A1 | 9/2010 |
| WO | WO-2010084249 | A2 | 7/2010 |

* cited by examiner

*Primary Examiner* — Daniel V Venne

(74) *Attorney, Agent, or Firm* — Harness, Dickey & Pierce, P.L.C.

(57) ABSTRACT

The present disclosure relates to a passenger ship, such as a passenger liner, which includes a main structure bounded by a hull and its upper deck, above which arises at least one superstructure, wherein it has at least one arch which stands generally fore and aft, and which extends at least partly over the main structure, its opposite ends being firmly joined to this main structure, so that the arch carries at least part of the loads connected with its deflection.

22 Claims, 4 Drawing Sheets

PASSENGER SHIP OF WHICH THE SUPERSTRUCTURE IS EQUIPPED WITH AT LEAST ONE ARCH

CROSS-REFERENCE TO RELATED APPLICATIONS

This application claims the benefit and priority of French Patent Application Serial No. 1153502, filed on Apr. 22, 2011, which is incorporated by reference herein.

BACKGROUND AND SUMMARY

The present invention relates to a passenger ship, such as a passenger liner or a ferry for example.

Such a ship comprises a main structure bounded by a hull and its upper deck (or freeboard deck), above which rises at least one superstructure consisting in particular of an assembly of decks and of longitudinal and transverse bulkheads (partition walls). The superstructures of these ships are subjected to loads generated by the deflection of the ship during its passage through the swell, loads that are manifested by a parabolic bending moment distribution and by a shear load. On large size ships of the passenger liner or ferry type, the type of construction of these superstructures involves said superstructures contributing to the aggregate strength of the ship. Consequently, they are taken into account for the strength calculation of the "hull girder", that is the girder schematic that represents the set of loads to which the structure of a ship is subjected. However these superstructures are currently made up of decks interconnected by interior bulkheads and/or boundary bulkheads called "platings", as well as by stanchions.

Depending on the type of construction selected, these interior bulkheads, particularly those oriented in the longitudinal direction of the ship, and these platings, the number of which is high, complicate the structure of ships. This involves not only a complication of the superstructure itself but also of the main structure aimed at ensuring structural continuity, incidentally increasing the overall weight of the superstructure and/or not allowing good natural illumination of the cabins and other passenger living spaces. In particular, in the interior portions of these ships, certain spaces are "blind", in the sense that they do not get the benefit of any outside lighting.

The present invention aims to resolve these problems. In other words, it has the object of proposing a ship the overall structure whereof is as strong as that of currently known ships, carrying the full set of loads, but allowing the elimination of part of the decks, the interior bulkheads and/or the platings of the superstructures, particularly so as to:

- simplify the structure of the ship and thus reduce the cost of its construction;
- lighten the weight of the superstructures and thus reduce the consumption of energy by the ship required for its propulsion and make it more stable by lowering its center of gravity;
- facilitate the layout of spaces by means of non-structural partitions;
- improve the lighting of the spaces.

Thus, the present invention relates to a passenger ship, such as a passenger liner, which includes a main structure bounded by a hull and its upper deck (or freeboard deck, which is positioned above a waterline defined by a displacement of the hull when the passenger ship is at rest). At least one superstructure rises above the upper deck and is characterized by the fact that it comprises at least one arch which stands generally fore and aft, and which extends at least partly over the main structure, its opposite ends being firmly joined to this main structure, so that the arch carries at least partly the loads connected with its deflection. In other words, said arch begins toward the stern and extends in the direction of the bow.

Thus, the arch aims to limit the deflection (deformation) of the ship when it is on the swell (in this case, the arch is in tension when the middle of the ship is on the crest of a swell, and in compression when the two ends of the ship are on the crest of a swell). This makes it possible to thus limit the bending of the ship, which constitutes an essential criterion in the classification of ships. In the present application, the term "deflection" signifies "deformation".

Preferably, when the superstructure consists particularly of an assembly of decks and of structural transverse bulkheads, at least part of the decks of the superstructure is fixed to this arch. The arch then also carries a large part of the loads to which the superstructure of the ship is subjected. It is thus possible, in the construction of the superstructures, to eliminate certain longitudinal structural bulkheads and/or some platings which are normally necessary for avoiding or limiting relative slippage of the decks and thus contribute to the aggregate strength of a ship according to the state of the art, particularly for resisting the shear loads thus generated.

This makes it possible, as already indicated above, to:

- simplify the structure of ships and thus to reduce their construction cost;
- lighten the weight of the superstructures and thus reduce the energy consumption of the ship required for its propulsion, and make it more stable by lowering its center of gravity;
- facilitate the layout of spaces by means of non-structural partitions and obtain spaces with greater dimensions;
- improve the lighting inside the ship.

According to other advantageous characteristics:

- said arch stands vertically and parallel to its longitudinal axis;
- said arch exhibits a discontinuity, i.e. it has an interruption in its middle zone, so that it consists of two curved branches with space between them;
- the ship has two arches arranged, symmetrically or not, on either side of its medial longitudinal axis;
- said arches extend in immediate proximity to the hull platings;
- the distance separating the opposite ends of said arch is substantially equal to the length of said ship;
- said arch is supported by stanchions or any equivalent structural means which, like a stanchion, allows the provision of large openings in the surroundings of the superstructures, so as to bring natural light to the interior of the ship;
- said arch consists of an assembly of preferably hollow struts;
- said arch consists of a mesh;
- said arch is made of metal, of composite material, for example based on carbon fibers, or of a combination of different materials;
- at least one part of the transverse structural bulkheads is joined to said arch;
- said arch is associated with at least one pillar the upper end whereof is joined to said arch, while its base is firmly joined to said main structure.

Other characteristics and advantages of the present invention will appear upon reading the detailed description of certain preferred embodiments.

BRIEF DESCRIPTION OF THE DRAWINGS

This description will be made with reference to the appended drawings wherein.

DETAILED DESCRIPTION

Figure 1:
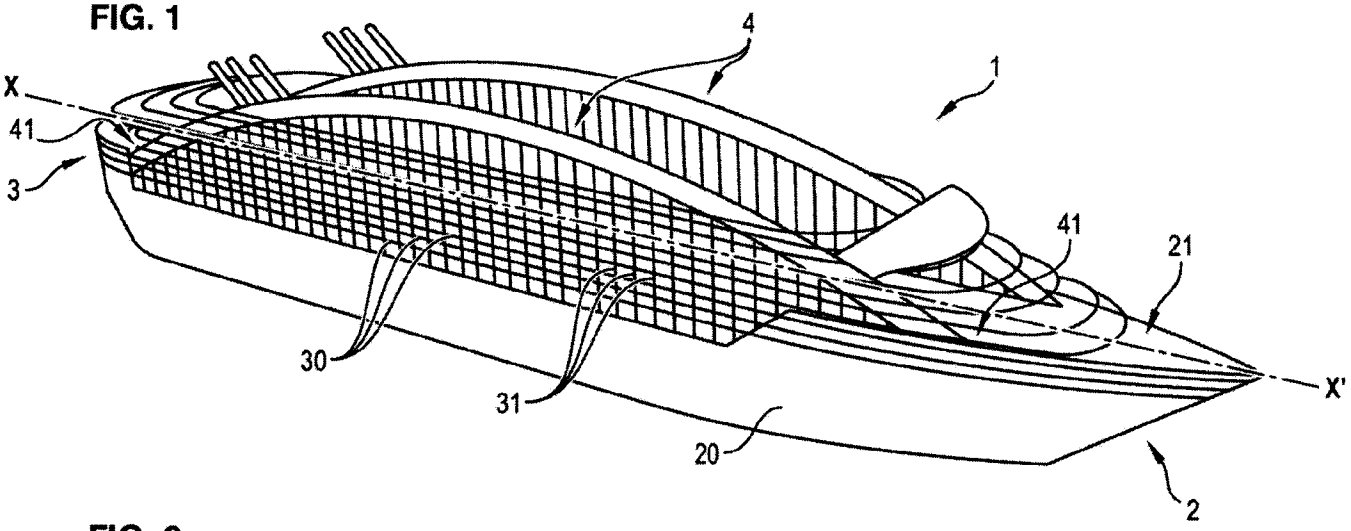
FIG. 1 is a schematic perspective view of a ship conforming to the invention.

The passenger ship which is shown in the figures and which consists of a passenger liner 1 has a structure that is generally known per se. To this end, it includes a main structure 2 which is bounded by a hull 20 and its upper deck 21. Such a main structure contains all the known equipment which conventionally equips a ship, this main structure being subdivided into different compartments which are bounded by decks and vertical bulkheads (partition walls), in the ship's longitudinal and transverse directions. The terms "longitudinal" and "transverse" are defined with reference to the longitudinal axis of the ship designated X-X', this axis corresponding to the direction of motion of said ship.

Above the main structure 2 rises a superstructure 3 which consists, as is also known, of an assembly of decks 30, of transverse structural bulkheads 31 and of stanchions. These are metal decks and bulkheads, pre-assembled together, which later receive all the operation and accommodation equipment necessary for the use of the ship. In conformity with an embodiment of the invention, this ship has the particular feature of including at least one arch 4 which stands vertically and parallel to the longitudinal axis X-X'. In the case presented here, these arches (or arcs) are two in number and are arranged symmetrically on either side of the medial axis X-X'. They extend in the neighborhood, i.e. in immediate proximity to the platings of the hull 20.

In a different embodiment, not shown, the number of arches and/or their arrangement could be otherwise. Thus, in the case where the ship is provided with a single arch, this extends in the medial position, that is along the axis X-X'.

Figure 2:
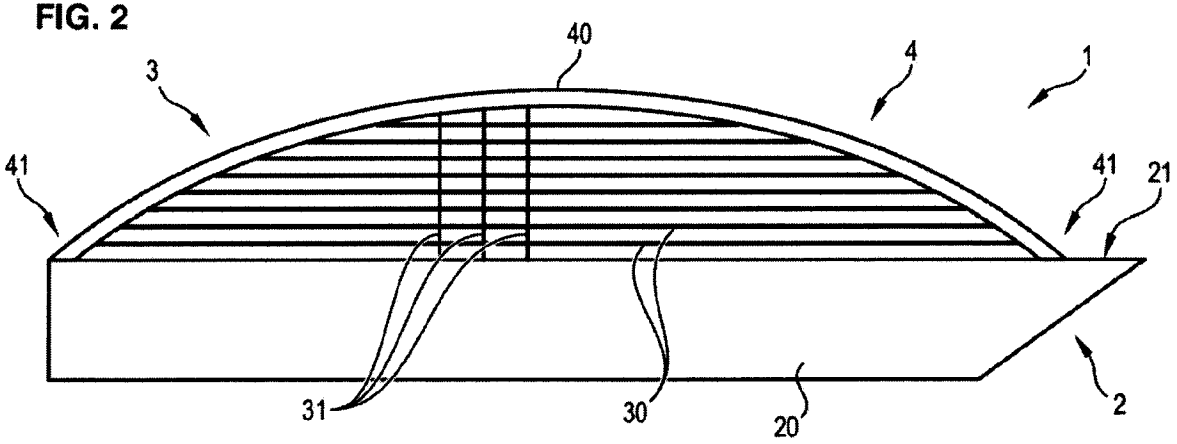
FIG. 2 is a side elevation of the ship of FIG. 1.

Said arch extends at least partly over the main structure 2 of the ship and its opposite ends 41 are firmly joined to this main structure 2, thus forming a load carrying assembly. The opposite ends 41 do not necessarily reach the stern and the bow of the ship, but the arch extends along a majority of the length of the ship. In conformity with the invention, at least part of the aforementioned decks 30 in the superstructure 3 is fixed to this arch, as partially shown in FIG. 2. Advantageously, at least one part of the bulkheads 31 (in this case the transverse structural bulkheads) of the superstructure 3 is fixed to this arch, as partially shown in FIG. 2. This arrangement is somewhat related to the structure of a "land" semi-trough arch bridge, the bridge deck in question consisting here of each of the decks of the superstructure.

Thanks to this arrangement, the loads generated by the decks and bulkheads of the superstructure, during the ship's passage through a swell or due to its roll, are carried by the arches 4 and are distributed to their opposite ends 41. Of course, these ends 41 must be effectively joined to the main structure, rigidly that is, their dimensions and their shape allowing them to transmit said loads to the main structure. Thus, when the arch consists of a metallic material, then these ends 41 will be joined to the main structure 2, by arc welding for example.

Figure 3:
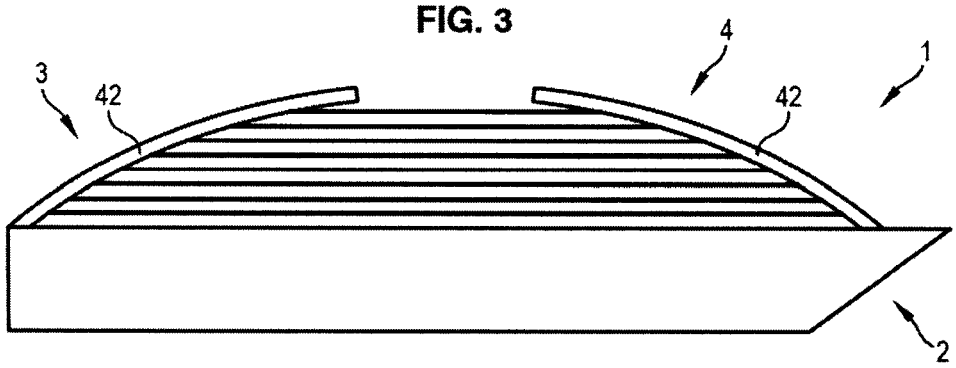
FIG. 3 is also a side elevation of a variation of implementation of this ship.

With reference to FIG. 3, a variation of implementation of the ship according to the invention is shown wherein the arch 4 shown exhibits a discontinuity, that is an interruption at its middle zone, so that it consists here of two curved branches 42 with space between them, in the extension of one another. In fact, the upper part of the arch is subjected to very little load so that it is possible to dispense with it. In order for this structure to be fully effective, it is necessary that the arches have the greatest possible longitudinal extent. Preferably therefore, the distance separating the opposite ends 41 of this arch is substantially equal to the length of the ship.

In the absence of platings, it is absolutely necessary that the arches be supported by stanchions or by an equivalent structural means, allowing the provision of large openings in this region (normally occupied by platings) of the superstructures, so as to bring natural light to the interior of the ship. As stated above, the arch 4 is preferably made of metal.

Figure 4:
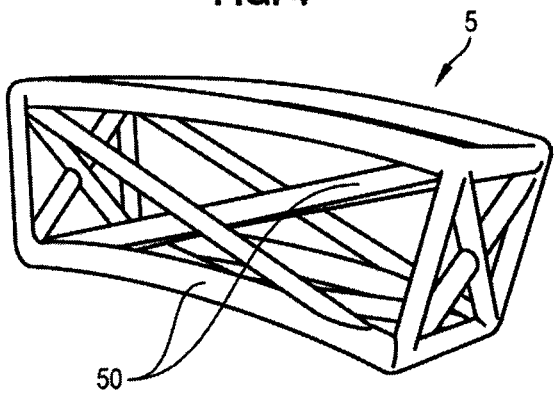
FIG. 4 is a perspective view of a constitutive element of an arch equipping the aforementioned ship.

In such a case it will be preferred to use, in building it, elements or modules in the form of meshes, such as those shown in FIG. 4, assembled together by any known means. These mesh elements have a generally parallelepiped shape, but with slightly curved walls and are made up of an assembly of metal tubes 50 welded together. Of course, it is possible to coat their different surfaces with a coating.

Figure 5:
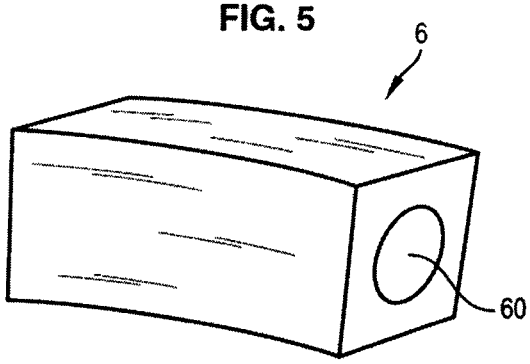
FIG. 5 is also a perspective view of a variation of such an element.

Of course, other types of material than metal can be used. In particular, any kind of composite material can be considered, particularly those based in carbon fiber. In such a case, and as shown in FIG. 5, the corresponding elements 6 will preferably have a longitudinal hole 60 in order to thereby lighten the structure.

Thanks to the presence of these arches, which carry the loads generated by the structure of the ship itself, it is possible, particularly in the construction of the superstructure 3, to eliminate all or part of the decks, longitudinal structural bulkheads and/or platings which are necessary in particular to the aggregate strength of the ship. By eliminating all or part of the longitudinal bulkheads and/or platings, spaces with larger dimensions can thereby be obtained and/or, in certain cases, the lighting of the interior of the ship can be improved.

Figure 6:
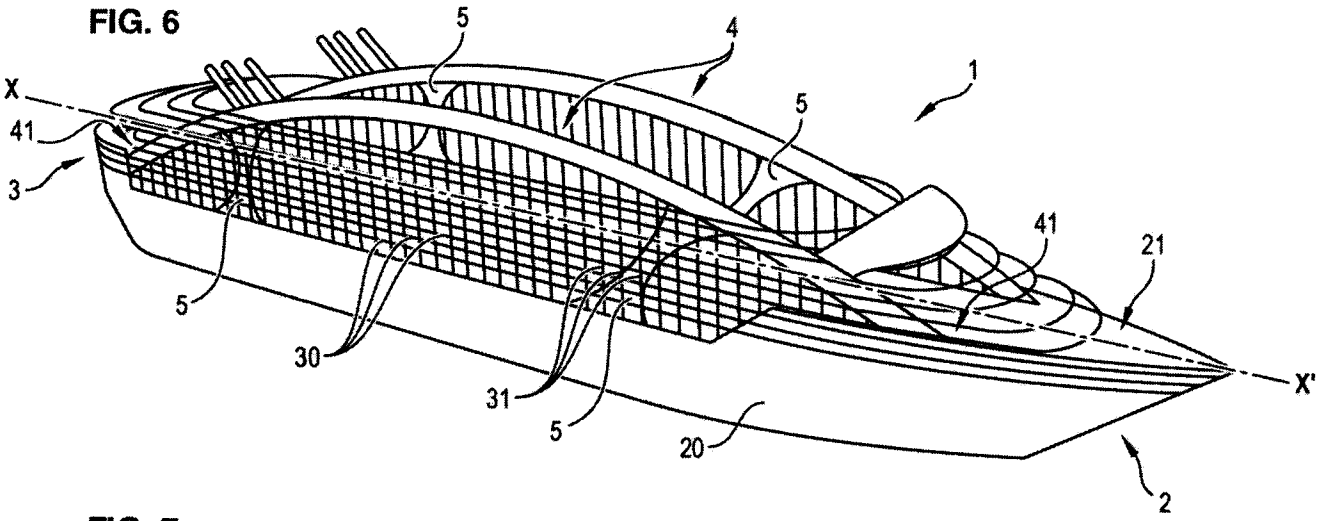
FIGS. 6 and 7 are views equivalent to FIGS. 1 and 2 of another embodiment of the invention.
Figure 7:
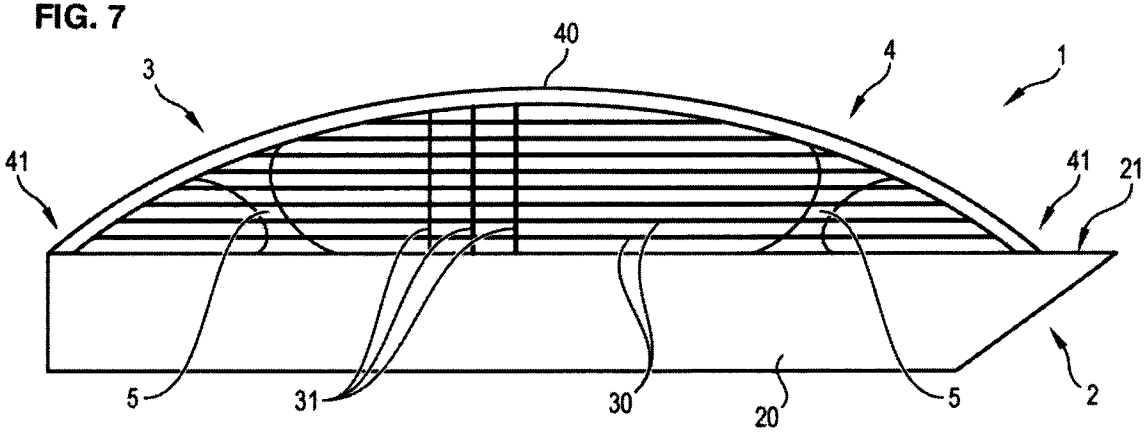

In the embodiment shown in FIGS. 6 and 7, we are dealing with a ship structure substantially identical to that described previously. However, in order to reinforce the structure and avoid any undesirable deflection, each arch 4 is associated with a pair of pillars 5. These pillars are arranged, slightly skewed in the direction of the associated ends of the ship.

They are joined at their upper end to the associated arch 4 and at their base to the main structure 2. Their function is to prevent any deflection of the arches and to carry part of the loads sustained by the latter. In a sense, these pillars function as stays.

Figure 8:
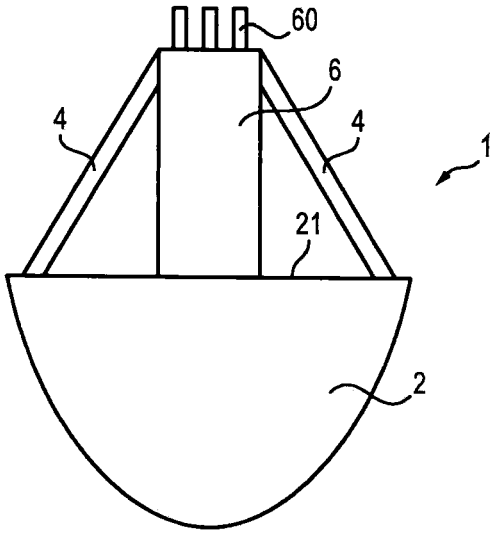
FIGS. 8 and 9 are very simplified views, respectively front and top, of two other embodiments of a ship according to the invention.
Figure 9:
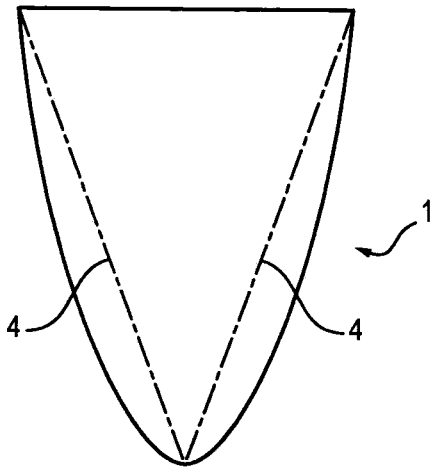

In a simplified embodiment of FIG. 8, the arches do not extend vertically but are arranged in a sloping manner that is offset from a vertical direction and are preferably supported on the "casing" 6, that is to say the metal structure which extends above the upper deck 21 and which provides the connection between the propulsion means and the chimneys 60 for exhausting smoke, or any other funnel structure which would offer a useful vertical support to the arch structure. Finally, in the embodiment of FIG. 9, the ship has a stern that is very wide compared to the bow. In this hypothetical case, it can be contemplated that the arches extend, not parallel to the longitudinal axis of the ship, but at an angle relative to the longitudinal axis and at an acute angle to one another.

The invention claimed is:

1. A passenger ship, comprising:

a main structure bounded by a hull and an upper deck;

at least one superstructure rising above said main structure of said passenger ship;

at least one arch that stands generally fore and aft and that extends at least partly over said main structure between opposite ends of said at least one arch;

said opposite ends of said at least one arch being joined to said main structure so that said at least one arch carries at least part of a load resulting from deflection of said at least one arch; and wherein said at least one superstructure includes an assembly including at least one deck and at least one transverse structural bulkhead, at least one part of said assembly of said at least one superstructure being joined to said at least one arch.

2. A passenger ship according to claim 1, wherein said at least one arch stands vertically and parallel to a longitudinal axis of said passenger ship.

3. A passenger ship according to claim 1, wherein said at least one arch includes a middle zone exhibiting a discontinuity such that said at least one arch includes two curved branches that are spaced apart from one another.

4. A passenger ship according to claim 1, wherein said at least one arch includes two arches arranged symmetrically on either side of a longitudinal axis of said passenger ship.

5. A passenger ship according to claim 4, wherein said opposite ends of said two arches are disposed adjacent to platings of said hull.

6. A passenger ship according to claim 1, wherein a distance that separates said opposite ends of said at least one arch is substantially equal to a length of said passenger ship.

7. A passenger ship according to claim 1, wherein said at least one arch is supported by stanchions that provide openings in a region of said at least one arch surrounding said at least one superstructure so as to bring natural light to an interior of said passenger ship.

8. A passenger ship according to claim 1, wherein said at least one arch includes an assembly of hollow struts.

9. A passenger ship according to claim 1, wherein said at least one arch includes a mesh.

10. A passenger ship according to claim 1, wherein said at least one arch is made of a material including at least one from a group of: metal, composite material, and carbon fibers.

11. A passenger ship according to claim 1, wherein at least part of said at least one transverse structural bulkhead is joined to said at least one arch.

12. A passenger ship according to claim 1, wherein said at least one arch is supported by at least one pillar, said at least one pillar including an upper end that is joined to said at least one arch and a base that is joined to said main structure.

13. A passenger ship, comprising:

a hull;

a superstructure rising above said hull;

at least one arch that stands generally fore and aft and that extends at least partly over said hull between a pair of opposite ends of said at least one arch;

said pair of opposite ends of said at least one arch being secured to said hull so that said at least one arch forms a load carrying assembly with said hull; and said superstructure including at least one deck and at least one transverse structural bulkhead, at least one part of said superstructure being connected to said at least one arch.

14. A passenger ship according to claim 13, wherein said at least one arch includes two arches arranged symmetrically on either side of a longitudinal axis of said passenger ship, and the arches include at least one of: fiber and composite materials.

15. A passenger ship according to claim 13, wherein a distance that separates said pair of opposite ends of said at least one arch is substantially equal to a length of said passenger ship.

16. A passenger ship according to claim 13, wherein said at least one arch includes a least one wall disposed about a hollow interior.

17. A passenger ship according to claim 13, wherein said at least one arch includes a mesh of support members that are connected to one another to form module having a parallelepiped shape.

18. A passenger ship, comprising:

a hull having a waterline defined by a displacement of said hull when said passenger ship is floating at rest;

a superstructure located above said hull;

at least one arch extending generally fore and aft and that extends at least partly over said hull between a pair of opposite ends of said at least one arch;

said pair of opposite ends of said at least one arch being secured to said hull so that said at least one arch forms a load carrying assembly with said hull; and said at least one arch being connected to said superstructure and located entirely above said waterline of said hull.

19. A passenger ship according to claim 18, wherein said pair of opposite ends of said at least one arch are spaced above said waterline by at least a portion of said hull.

20. A passenger ship according to claim 18, wherein said at least one arch includes two arches arranged symmetrically on either side of a longitudinal axis of said passenger ship.

21. A passenger ship according to claim 18, which is one of: a passenger liner and a ferry, including multiple decks and bulkheads, and at least said one of said decks and at least one of said bulkheads are attached to said at least one arch.

22. A passenger ship according to claim 18, wherein said at least one arch include two arches acutely angled relative to each other in a non-parallel manner and offset at an angle relative to a longitudinal axis of said ship, and said arches each extending a majority of a length of said ship and being arranged in a sloping manner that is offset from a vertical direction.

* * * * *